US006597364B1

(12) United States Patent
Chiu et al.

(10) Patent No.: US 6,597,364 B1
(45) Date of Patent: Jul. 22, 2003

(54) METHOD AND SYSTEM FOR ELIMINATING FRAME TEARS FROM AN OUTPUT DISPLAY

(75) Inventors: Yung-feng Chiu, Miao Li (TW); Chia-chieh Chen, San Chung (TW); Yuh-sen Jaw, Hsin Chu (TW)

(73) Assignee: Silicon Integrated Systems Corp. (TW)

( * ) Notice: Subject to any disclaimer, the term of this patent is extended or adjusted under 35 U.S.C. 154(b) by 430 days.

(21) Appl. No.: 09/632,692

(22) Filed: Aug. 4, 2000

(51) Int. Cl.[7] ..... G09G 5/37
(52) U.S. Cl. ..... 345/562; 345/537
(58) Field of Search ..... 345/501–506, 345/519–520, 522, 530–574

(56) References Cited

U.S. PATENT DOCUMENTS 4,718,024 A * 1/1988 Guttag et al. ..... 364/518
5,751,295 A * 5/1998 Becklund et al. ..... 345/501
6,052,129 A * 4/2000 Fowler et al. ..... 345/434
6,069,633 A * 5/2000 Apparao et al. ..... 345/521
6,091,432 A * 7/2000 Diehl et al. ..... 345/525
6,097,401 A * 8/2000 Owen et al. ..... 345/503

* cited by examiner

*Primary Examiner*—Kee M. Tung
(74) *Attorney, Agent, or Firm*—Martine & Penilla, LLP

(57) ABSTRACT

A method and system for rendering computer graphics display tear-free is provided by determining a safe region for each associated block transfer command in real time. In response to a request of a graphics application program, a block transfer type is determined according to relative positions of a destination bitmap, and a source bitmap on the frame buffer. The invention defines three block transfer types: a top-down block transfer type, a bottom-up block transfer type and a direct block transfer type. Each of these block transfer types has an associated block transfer command for issuing to a command queue. After receiving each associated block transfer command, a safe region for an associated block transfer command will be determined in real time. Then, information from a source bitmap is transferred to a destination bitmap when the position of the current scan line is within the determined safe region defined for the associated block transfer command.

13 Claims, 8 Drawing Sheets

Executed By CPU

METHOD AND SYSTEM FOR ELIMINATING FRAME TEARS FROM AN OUTPUT DISPLAY

BACKGROUND OF THE INVENTION

A. Field of the Invention

The present invention relates to a method and system for rendering computer graphics display tear free, especially to a method and system which can quickly furnish information to the on-screen display by determining a safe region in real time.

B. Description of the Prior Art

"Frame tear" is a problem occurred in computer graphics display. It results in a flickering on the output display which is disturbing to a viewer especially when he/she is producing an animated graphical output. The problem of a frame tear occurs because the data transferred to a frame buffer is not synchronized to the scan out of the frame buffer. Refer to FIG. 1 for showing an example of a frame tear, in which the image data for the portion A comes from a frame different from the image source of the portion B. As a result, the information scanned to the output display as a single frame is actually from two sequential frames. The inconsistency between the two pictures from two sequential frames appears as a "tear" to the viewer.

To solve this problem, a conventional method eliminates the frame tear problem by utilizing an interrupt mechanism. In accordance with the conventional method, an interrupt is generated to signal the beginning of the safe region to start furnishing data to a frame buffer. The problem of the interrupt method is that it cannot be adapted for a command-queue-based graphics accelerative engine:. So, it cannot furnish information to the on-screen display by determining a safe region in real time. Moreover, since it must block CPU (Central Process Unit) until the beginning of the safe region is initiated, so it takes a longer time to process. As a result, its speed for transferring image data to the frame buffer is heavily dependent on the speed of the CPU.

SUMMARY OF THE INVENTION

It is an object of the present invention to provide an improved method and system which can solve the frame tear problem efficiently by determining a safe region in real time.

It is another object of the present invention to provide an improved method and system which is adaptable for a command-queue-based graphics accelerative engine, thereby to accelerate image transfer.

In accordance with the invention, an aspect of the present invention provides a method for eliminating frame tears from an output display. The method includes the following steps: (1) Determine a block transfer type for each request of an application program. The block transfer type includes a top-down block transfer type, a bottom-up block transfer type, and a direct block transfer type. (2) Send a block transfer command to a command queue in response to the determined block transfer type. (3) Determine a safe region for each of the determined block transfer command. (4) Transfer information from a source bitmap to a destination bitmap when a current scan line is within the safe region determined for the associated block transfer command.

The top-down block transfer type is determined when either one of the following conditions applies: (1) The destination bitmap is selected from a portion of the on-screen display, and the source bitmap is a part of the off-screen display. (2) Both of the destination and source bitmaps are part of the on-screen display, and the top position of the destination bitmap is at a position higher than the top position of the source bitmap. (3) Both of the destination and source bitmaps are part of the on-screen display, and the top position of the destination bitmap is at a lower position than the top position of the source bitmap, and not overlapped.

A bottom-up block transfer type is determined when all of the following conditions applies: (1) Both of the destination and source bitmaps are part of the on-screen display. (2) The top position of the destination bitmap is at a lower position than the top position of the source bitmap. (3) The destination and source bitmaps are overlapped. And (4) the height of the destination bitmap is less than half of the height of the source bitmap.

A direct block transfer is performed when the destination bitmap is not selected from the on-screen display. In that case, no frame tear problem will occur because the block transfer is performed behind the scene.

After determining the block transfer type for a request, a safe region for the determined block transfer command must be determined. Then, calculate the safe region to perform block transferring operation according to the correspondent block transfer type and current scan line position.

In another aspect of the present invention, the system of the present invention mainly includes: a graphics driver having a mechanism for determining a block transfer type in response to each request of a graphic application program. The graphics driver sends a block transfer command to a command queue in response to each determined block transfer type. The graphic driver accesses the command queue and the graphics accelerative engine receives the determined block transfer command. A scan line counter records a current position of the scan line. The graphics accelerative engine has a mechanism for determining a safe region for each of the determined block transfer command in response to the current position of the scan line. The graphics accelerative engine accesses the frame buffer and transfers information from a source bitmap to a destination bitmap when the current scan line is within the safe region for the determined block transfer command.

BRIEF DESCRIPTION OF THE DRAWINGS

These and other objects and advantages of the present invention will become apparent by reference to the following description and accompanying drawings wherein.

DETAILED DESCRIPTION OF THE PREFERRED EMBODIMENTS

A bit block transfer (Blt) is an operation to transfer the data from a source bitmap to a destination bitmap. The transfer is controlled by a ternary raster operation value that specifies how the corresponding bits from the source, destination, and pattern in a brush are combined to form the final bit streams in the destination bitmap. The on-screen display refers to the portion of the frame buffer that is currently displayed on the screen. In contrast, the off-screen display means the portion of the frame buffer that has not been displayed on the screen yet.

Figure 8:
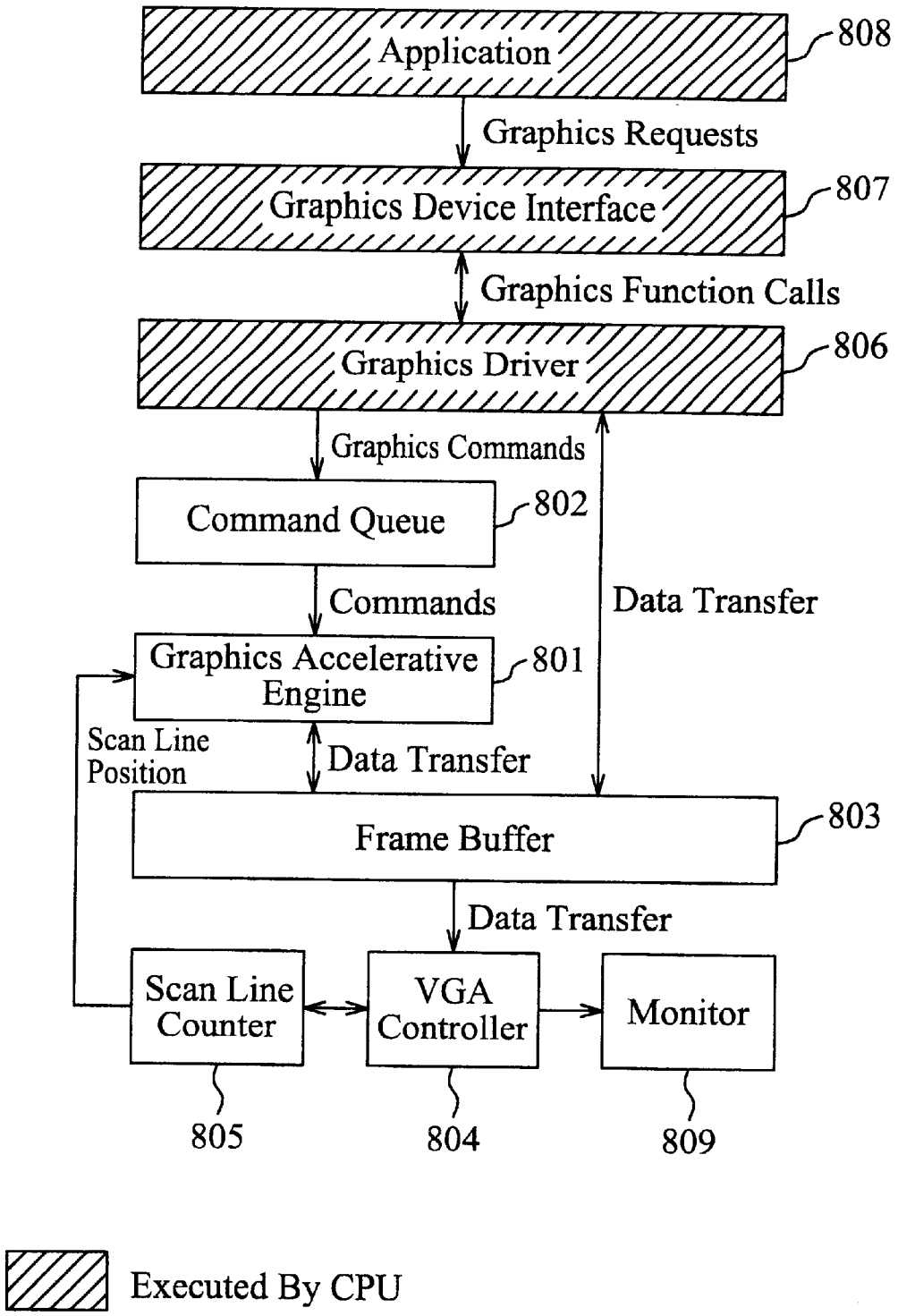
FIG. 8 is a block-diagram showing the system of the invention in accordance with a preferred embodiment of the invention.

To eliminate the occurrences of frame tears, a safe region for the scan line must be determined first for transferring information from the source bitmap to the destination bitmap safely. The determination for a safe region is based on two factors: the rate at which information is transferred to the frame buffer and the position at which transfer begins. For the preferred embodiment of the present invention, the mechanism for determining a safe region in response to various block transfer type are executed by a graphics accelerative engine 801, as illustrated in FIG. 8. The graphics driver 806 of the present invention determines a block transfer-command type for each request of graphics application program.

Figure 1:
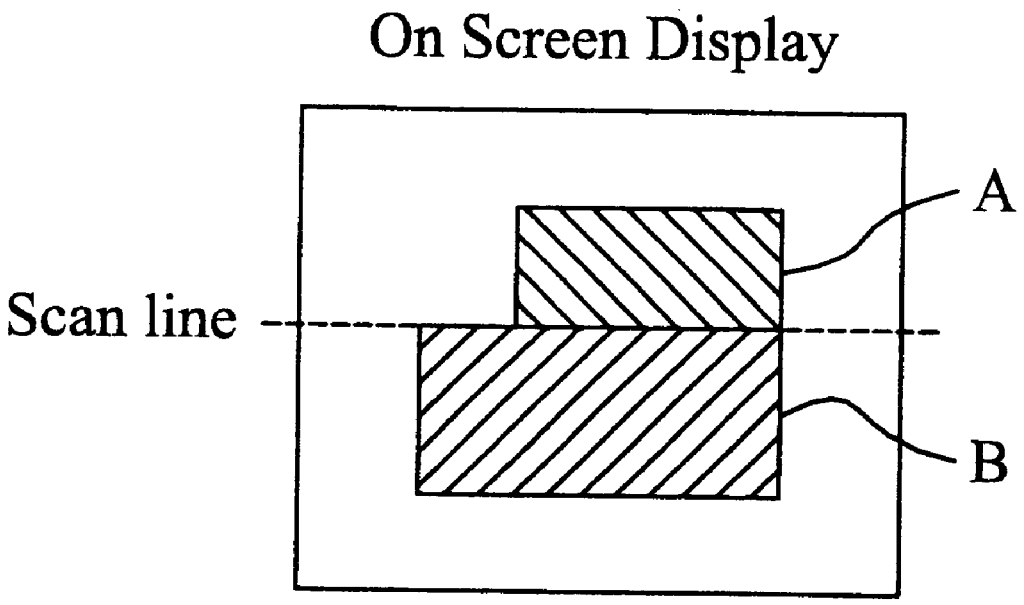
FIG. 1 is a schematic diagram showing an example of a frame tear.
Figure 2:
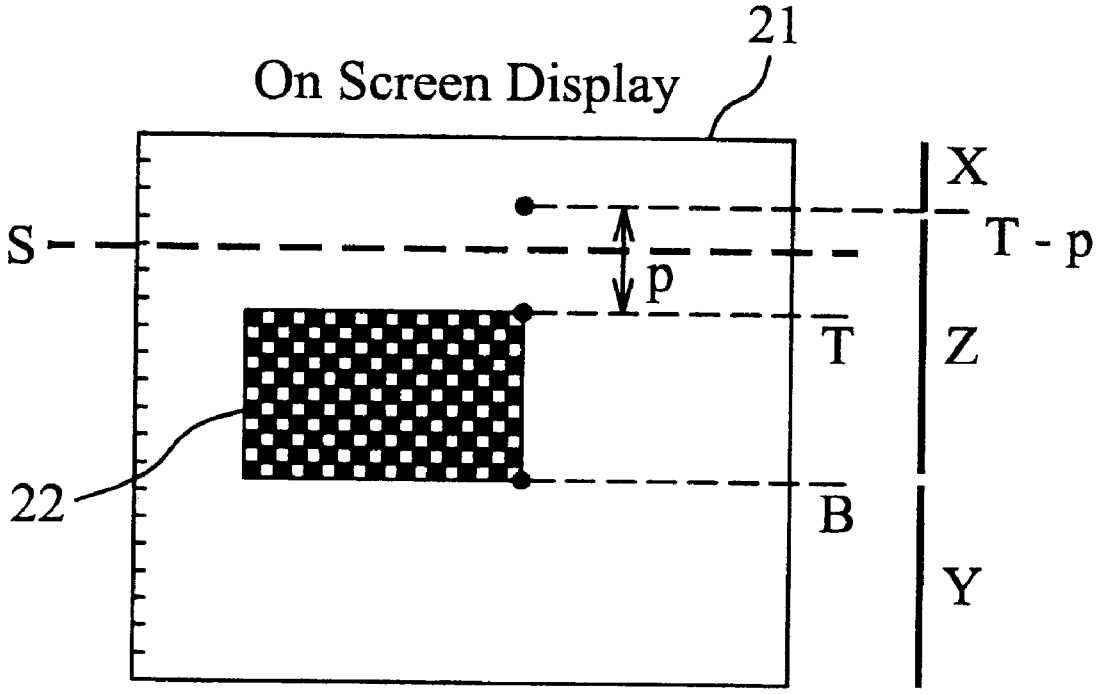
FIG. 2 is a schematic diagram showing the method for determining a safe region for the top-down block transfer.

For example, refer to FIG. 2, in an on-screen display 21, S represents the horizontal position of a scan line, T the top position of the destination bitmap 22, B the bottom position of the destination bitmap 22, p the guard band for preventing the raster beam from over-reading. The value of p is determined based on a default value predetermined by a hardware design. For example, the default value for p is 1.

If the scan line S is in the upper safe region X of the on-screen display 21 determined by T-p, the scan rate of the raster beam cannot catch up with the speed of transferring information from the frame buffer to the destination bitmap 22 due to such a safe distance. As a result, the frame tear will not occur. In another case, if the scan line is in the lower safe region Y of the display determined by B, the scan rate of the raster beam cannot catch up with the speed of transferring information from the frame buffer to the destination bitmap 22 . So, the problem of frame tears will not occur either under such situation.

However, if the scan line S is in the dangerous region Z which is defined as the area between T−p and B, the graphics accelerative engine 801 can have two approaches: (1) Keep checking if the current scan line is still maintaining a safe distance with the top position of the destination bitmap plus the counter value i (T+i) while performing block transfer operations on a line-by-line basis. (2) Wait until the current scan line reaches the lower safe region Y The second approach is safer but slower. Since the cost for checking is minimum, the first approach is adopted in a preferred embodiment of the invention.

Figure 3:
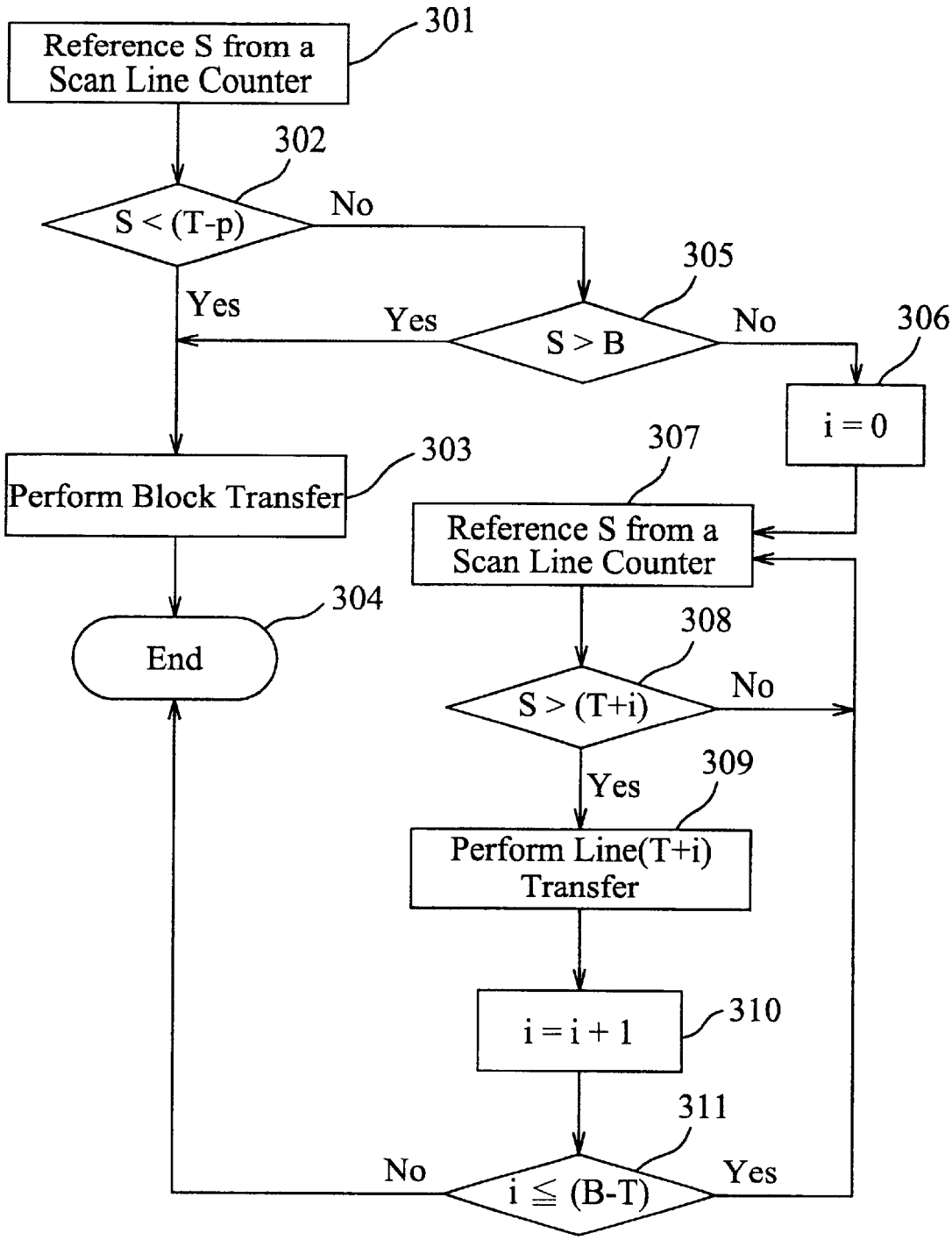
FIG. 3 is a flowchart showing the method for determining a safe region for the top-down block transfer.

Assume that the graphics accelerative engine 801 precedes data that reaches a rate faster than the scanning of data. For the above situation, the invention provides a top-down block transfer method as illustrated in FIG. 3. Step 301: reference the scan line S from the scan line counter of the VGA controller 804. Step 302: determine if the horizontal position of a scan line S is higher than T−p. If yes, it indicates that the scan line S is in an upper safe region X and it is safe to transfer image from a frame buffer to the destination bitmap 22 in an order from top to bottom. So, go to step 303 to perform block transfer. Then, go to step 304 to stop.

On the other hand, if the horizontal position of a scan line S is at a position lower than T−p, go to step 305 to further check if the horizontal position of the scan line S is lower than B. If yes, it indicates that the current scan line is at a lower safe region Y, so go to step 303 to perform block transfer. If the scan line S has not reached the lower safe region Y, it must be in the dangerous region. So, go to step 306 to initiate a counter (i). And then go to step 307 to reference the scan line counter value S. And then, go to step 308 to check if the scan line counter value S is larger than the top position of the bitmap plus the counter value i (T+i). If no, it means that current scan line is still within a dangerous region, so return to step 308. If yes, go to step 309 to perform the block transfer on the line of (T+i) only. And then, go to step 310 to increment the counter. Then, go to step 311 to check if the counter value is less or equal to the bottom position of the destination bitmap minus the top position of the destination bitmap (B−T). If yes, it indicates that there are more bitmap need to transfer, so go to step 308. If no, go to step 304 to stop.

Figure 4:
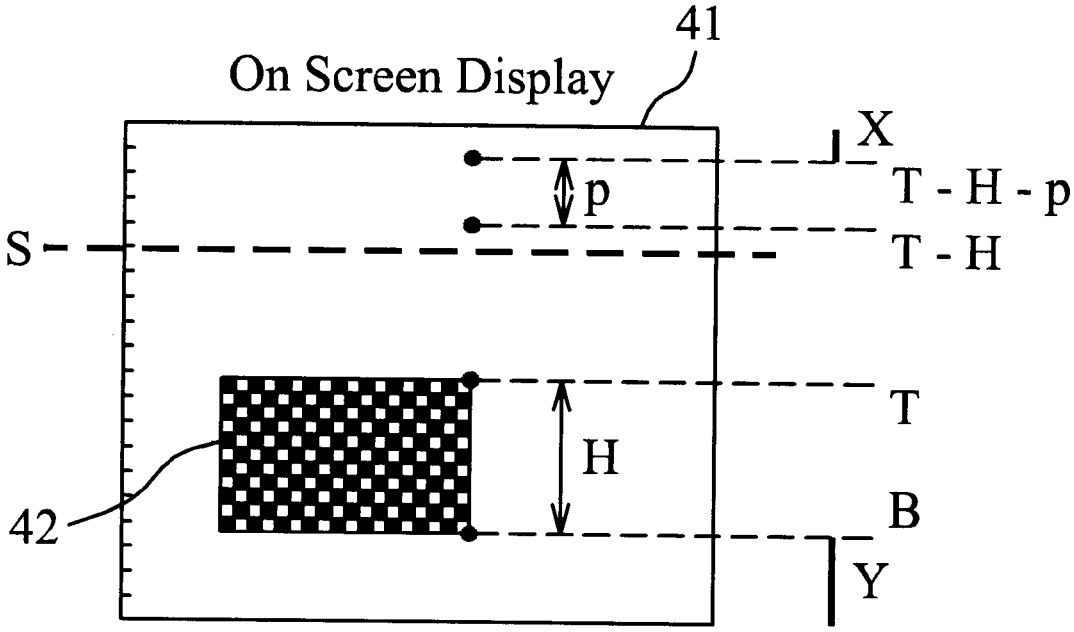
FIG. 4 is a schematic diagram showing the method for determining a safe region for the bottom-up block transfer.

Refer to FIG. 4 for showing the method for determining a safe region for a bottom-up block transfer command. In an on-screen display 41, S represents the horizontal position of a current scan line, T the top position of the destination bitmap 42, B the bottom position of the destination bitmap 42, H the height of the destination bitmap 42, p the guard band for preventing the raster beam from over-reading. Accordingly, if the scan line S is in the upper safe region X determined by T−H−p, the scan rate of the raster beam cannot catch up with the speed of transferring information from the frame buffer to the destination bitmap 42. So, the frame tear problem will not occur. On the other hand, if the scan line S is in the lower safe region Y of the display determined by B, the scan rate of the raster beam cannot catch up with the speed of transferring information from the frame buffer to the destination bitmap 42. So, it is safe to transfer the image data from the frame buffer to the destination bitmap 42 at this moment because a tear will not occur under such a situation.

Figure 5:
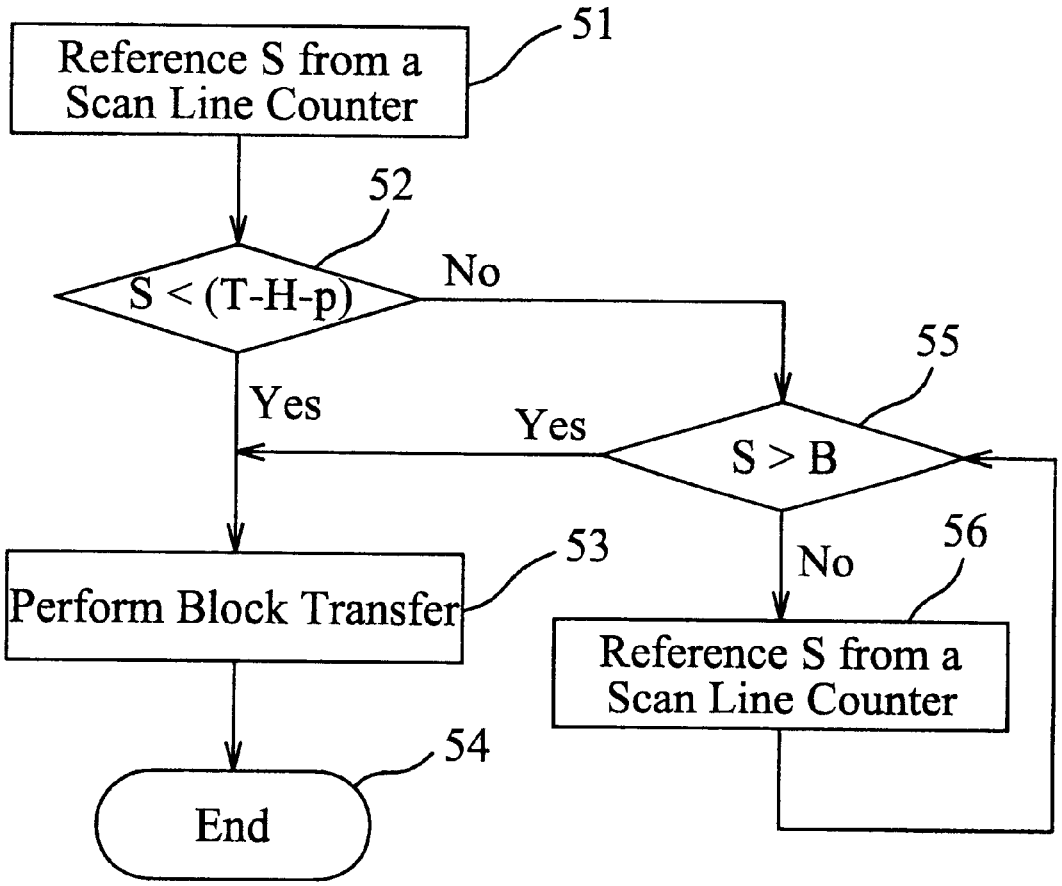
FIG. 5 is a flowchart showing the method for determining a safe region for the bottom-up block transfer.

Assume that the graphics accelerative engine 801 precedes data that reaches a rate faster than scanning of data. Refer to FIG. 5 for showing the flowchart of the bottom-up block transfer method as illustrated in FIG. 4. Step 51: reference the scan line S from the scan line counter of the VGA controller. Step 52: determine if the horizontal position of the scan line S is at a position higher than T−H−p. If yes, it indicates that the scan line S is in a safe region X and it is safe to transfer image from a source bitmap to the destination bitmap 42 in an order from bottom to top. So, go to step 53 to perform block transfer. Then, go to step 54 to stop. On the other hand, if the horizontal position of a scan line S is at a position lower than T−H−p, go to step 55 to check if the horizontal position of the scan line S is at a position lower than B. If yes, it indicates that the scan line S is already in the lower safe region Y, so go to step 53 to perform block transfer. On the other hand, if the scan line S has not reached the lower safe region Y, go to step 56 to wait and keep making reference to the scan line counter until it has reached the lower safe region Y.

Figure 6:
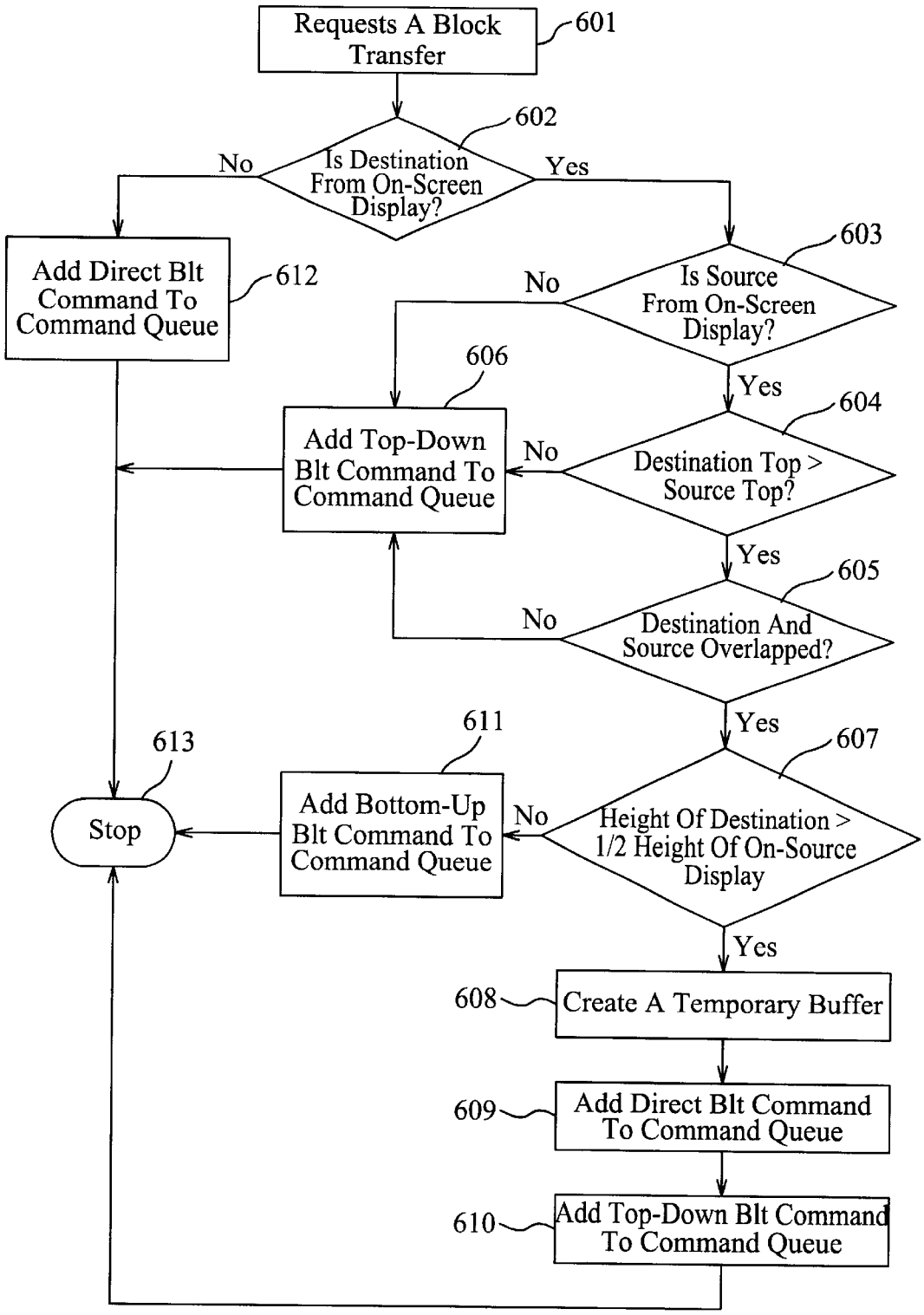
FIG. 6 is a flowchart showing the method for determining a block transfer type in response to an application program request.

In response to a request of the application program, the method for determining the type of block transfer can be described more clearly with reference to FIG. 6. For the preferred embodiment of the invention, these steps are executed by a graphics driver 806 in the CPU. Step 601: the application program requests a block transfer. Step 602: determine if the destination bitmap is selected from the on-screen display? If no, it means the block transfer is performed without showing on the output display, so go to step 612 to issue a direct block transfer command to the command queue . If yes, it means that the data transferring to the on-screen display is from a source bitmap, so go to step 603.

At step 603, check if the image data in the source bitmap is part of the on-screen display? If yes, go to step 604. If not, go to step 606 to issue a top-down block transfer command to the command queue. Step 604: Check if the top position of the destination bitmap is at a position lower than the top position of the source bitmap? If yes, go to step 605. If not, go to step 606.

Step 605: Check if the destination bitmap and the source bitmap are overlapped? If yes, go to step 607. If not, go to step 606. Step 606: Issue a top-down block transfer command to the command queue. Step 607: Check if the height of the destination bitmap is larger than half height of the source bitmap? If yes, it indicates that the area for bit block transfer is very large, so go to step 608 to use the double buffer technology. If not, go to step 611.

Step 608: Since the area of the destination bitmap is very large, so create a temporary buffer in the off-screen display to store the data of the source bitmap. Step 609: Issue a direct block transfer command to the command queue to transfer the image data from the source bitmap to the temporary buffer. Step 610: Issue a top-down block transfer command to the command queue. And then, terminate the block transfer, step 613.

Step 611: Issue a bottom-up block transfer command to the command queue. Step 612: Issue a direct block transfer command to the command queue. And then, Terminate the block transfer, step 613.

Figure 7:
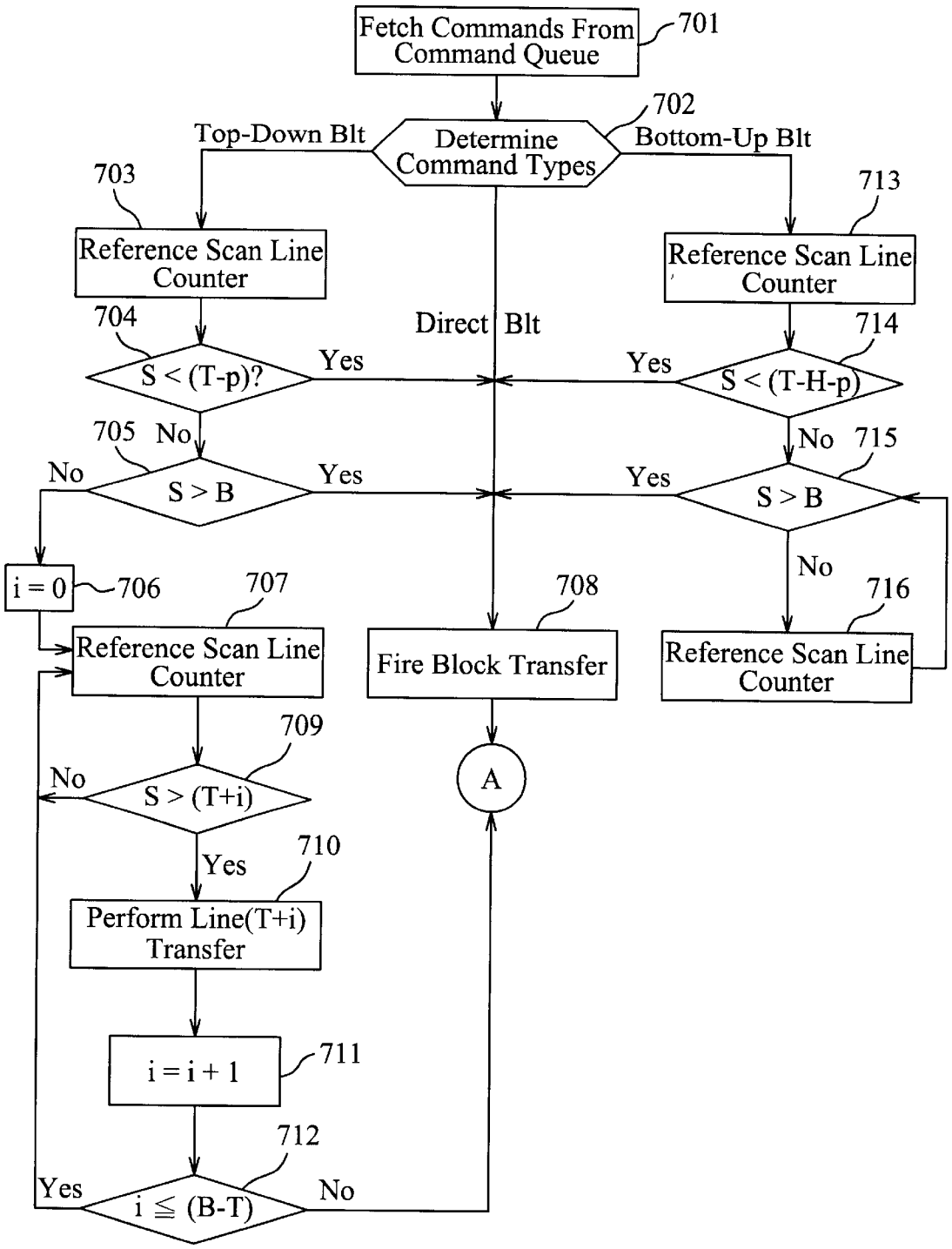
FIG. 7 is a block diagram showing the method for determining a safe region for each block transfer command.

The command queue 802 is a passive element. The graphics accelerative engine 801 reads each command from the command queue 802 and performs the associated safe region determination according to the flowcharts of FIG. 3 and FIG. 5. For instance, refer to FIG. 7, a graphics accelerative engine 801 fetches commands from the command queue 802, step 701. The commands are filtered according to their command types, including the top-down block transfer command, the bottom-up block transfer command, and direct block transfer command.

For top-down block transfer command, make reference to scan line counter, step 703. Determine if the scan line counter value S is smaller than the top position of the destination bitmap (T) minus the guard band offset (p), step 704. If yes, fire the block transfer, step 708. If not, check if the scan line counter value S is larger than the bottom position of the destination bitmap (B). If yes, fire the block transfer, step 708. If no, it indicates that the current scan line is in a dangerous region, so go to step 706 to initiate the counter i.

Then, go to step 707 to reference the scan line counter value S. And then, go to step 709 to check if the counter value S is larger than the top position of the bitmap plus the counter value i (T+i). If no, it means that current scan line is still within a dangerous region, so return to step 707. If yes, go to step 710 to perform the block transfer on the line of (T+i) only. And then, go to step 711 to increment the counter. And then, go to step 712 to check if the counter value is less or equal to the bottom position of the destination bitmap minus the top position of the destination bitmap (B−T). If yes, go to step 707. If not, go to step A.

For the direct block transfer command, the block transfer is executed at step 708 without worrying about the occurrence of frame tear. On the other hand, for a bottom-up block transfer command, the graphics accelerative engine 801 makes reference to the scan, line counter 805, step 713. Determine if the scan line counter value S is smaller than the top position of the destination bitmap(T) minus the height of the destination bitmap (H) and the guard band offset (p), step 714. If yes, fire the block transfer, step 708. If not, check if the scan line counter value S is larger than the bottom position of the destination bitmap (B), step 715. If yes, fire the block transfer, step 708. If not, wait and keep making reference to the scan line counter 805 until the scan line is in a lower safe region, step 716.

The system in accordance with the preferred embodiment of the invention described above can be described more clearly by referring to FIG. 8. A graphics application program 808 calls graphics device interface 807 functions to make graphics output requests. Graphics device interface 807 is an operating system dependent module between the graphics driver 806 and the graphics application program 808. Graphics device interface 807 communicates with the graphics driver 806 via a set of device driver interface functions. Information is passed between graphics device interface 807 and the Graphics driver 806 through the input/output parameters of these entry points. The Graphics driver 806 supports certain device driver interface functions for graphics device interface 807 to call. The Graphic driver 806 supports the requests of graphics device interface 807 by performing the appropriate operations requested by the input commands in the command queue 802 before returning to graphics device interface 807. The graphics application program 808, graphics device interface 807, and graphics driver 806 are performed in the CPU.

On the other hand, the VGA controller 804 reads data from the frame buffer 803, according to scan line counter 805 decodes the data, and sends the resulting color signals to the output display 809 during each refresh cycle. In response to the scan line position, the graphics accelerative engine 801 reads commands from the command queue 802 and changes the graphics values in the frame buffer 803 for transferring the bitstreams to the output display 809 via the VGA controller 804.

Since the invention utilizes the command queue for buffering various block transfer types in response to each request of a graphics application program, so the executions of the CPU and the graphics accelerative engine are performed at the same time. This advantage can efficiently improve the speed for block transfer and determine a safe region for furnishing information to the on-screen display in real time.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A method for eliminating frame tears on an output display, which is executed provided that block transfer commands have been sent to a command queue in a programmable manner while a block transfer type is determined, comprising the steps of:

receiving the determined block transfer type in response to a request from a graphics application program, said block transfer type being one selectable from a top-down block transfer type, a bottom-up block transfer type and a direct block transfer type dependent on relative positions of a current scan line, a destination bitmap, a source bitmap and an on-screen display, wherein the current scan line is automatically detected by hardware, and the scan line will fall behind the destination bitmap if the destination bitmap is located in the outside of region of the on-screen display;

determining whether said current scan line is separated from a region within the on-screen display, which is dependent on the relative positions of the destination bitmap, by an interval in distance or not according to said command queue formed by the block transfer commands; and transferring information from a source bitmap to the destination bitmap when the position of said current scan line is within the interval in distance, wherein the steps of receiving the determined block transfer type, determining whether said current scan line is separated from a region within the on-screen display, and transferring information from a source bitmap to the destination bitmap are successively executed in order in a fixed manner after the block transfer commands have been sent to the command queue in the programmable manner.

2. The method as claimed in claim 1, wherein said step of receiving the determined block transfer type comprises the step of:

determining said top-down block transfer type for said graphics application program when said destination bitmap is within the range of said on-screen display.

3. The method as claimed in claim 2, wherein said step of receiving the determined block transfer type comprises the step of:

determining said top-down block transfer type for said graphics application program when the top position of said destination bitmap is higher than the top position of said source bitmap.

4. The method as claimed in claim 3, wherein said step of receiving the determined block transfer type comprises the step of:

determining said top-down block transfer type for said graphics application program when said destination bitmap is not overlapped with said source bitmap.

5. The method as claimed in claim 4, wherein said step of receiving the determined block transfer type comprises the step of:

determining said bottom-up block transfer type for said graphics application program when the height of said destination bitmap is less than or equal to half the height of said output display.

6. The method as claimed in claim 5, wherein said step of receiving the determined block transfer type comprises the steps of:

copying information of said source bitmap to a temporary memory space when said height of destination bitmap is greater than half the height of said output display; and issuing said top-down block transfer command with the reference of said temporary memory space to said command queue.

7. The method as claimed in claim 1, wherein said step of determining whether said current scan line is separated from a region within the on-screen display, which is dependent on the relative positions of the destination bitmap, by an interval in distance or not comprises the step of:

determining whether said current scan line is separated from a region within the on-screen display for said top-down block transfer command when the current position of said scan line is at a position higher than the top position of said destination bitmap with a guard band offset.

8. The method as claimed in claim 7, wherein said step of determining whether said current scan line is separated from a region within the on-screen display, which is dependent on the relative positions of the destination bitmap, by an interval in distance or not comprises the step of:

determining whether said current scan line is separated from a region within the on-screen display for said top-down block transfer command when the current position of said scan line is at a position lower than the bottom position of said destination bitmap.

9. The method as claimed in claim 8, wherein said step of determining whether said current scan line is separated from a region within the on-screen display, which is dependent on the relative positions of the destination bit map, by an interval in distance or not comprises the step of:

determining whether said current scan line is separated from a region within the on-screen display for said top-down block transfer command when the current position of said scan line is at a position between the top position of said destination bitmap minus a guard band offset and the bottom position of said destination bitmap.

10. The method as claimed in claim 9, wherein said step of determining whether said current scan line is separated from a region within the on-screen display, which is dependent on the relative positions of the destination bitmap, by an interval in distance or not comprises the step of:

transferring information from a source bitmap to said destination bitmap on a line-byline basis when said current scan line is at a position lower than the top position of said destination bitmap plus a counter value.

11. The method as claimed in claim 8, wherein said step of determining whether said current scan line is separated from a region within the on-screen display, which is dependent on the relative positions of the destination bitmap, by an interval in distance or not comprises the step of:

determining whether said current scan line is separated from a region within the on-screen display for said bottom-up block transfer command when the current position of said scan line is at a position higher than the top position of said destination bitmap minus said height of said destination bitmap and a guard band offset.

12. The method as claimed in claim 11, wherein said step of determining whether said current scan line is separated from a region within the on-screen display, which is dependent on the relative positions of the destination bitmap, by an interval in distance or not comprises the step of:

determining whether said current scan line is separated from a region within the on-screen display for said bottom-up block transfer command when the current position of said scan line is at a position lower than the bottom position of said destination bitmap.

13. The method as claimed in claim 7, wherein said step of determining whether said current scan line is separated from a region within the on-screen display, which is dependent on the relative positions of the destination bitmap, by an interval in distance or not comprises the step of:

determining whether said current scan line is separated from a region within the on-screen display for said bottom-up block transfer command when the current position of said scan line is at a position lower than the bottom position of said destination bitmap with a guard band offset.

* * * * *